US009119420B2

(12) United States Patent
Sebastian

(10) Patent No.: US 9,119,420 B2
(45) Date of Patent: Sep. 1, 2015

(54) FILTER ELEMENT COMPRISING MULTIFUNCTIONAL FIBROUS SMOKE-ALTERING MATERIAL

(71) Applicant: R.J. Reynolds Tobacco Company, Winston-Salem, NC (US)

(72) Inventor: Andries Don Sebastian, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 14/231,927

(22) Filed: Apr. 1, 2014

(65) Prior Publication Data

US 2014/0210127 A1 Jul. 31, 2014

Related U.S. Application Data

(62) Division of application No. 12/847,228, filed on Jul. 30, 2010, now Pat. No. 8,720,450.

(51) Int. Cl.
*A24D 3/00* (2006.01)
*A24D 3/12* (2006.01)
(Continued)

(52) U.S. Cl.
CPC ..... *A24D 3/0229* (2013.01); *A24D 3/08* (2013.01); *A24D 3/10* (2013.01); *A24D 3/12* (2013.01); *A24D 3/16* (2013.01); *D01F 1/10* (2013.01); *D01F 2/28* (2013.01); *D01F 6/04* (2013.01); *D06M 10/04* (2013.01); *D06M 11/74* (2013.01); *D06M 11/77* (2013.01); *D06M 11/79* (2013.01);
(Continued)

(58) Field of Classification Search
CPC ..... A24D 3/0229; A24D 3/08; A24D 3/10; A24D 3/12; A24D 3/16; D06M 10/04
USPC ..... 131/331–346
See application file for complete search history.

(56) References Cited

U.S. PATENT DOCUMENTS 2,794,239 A 6/1957 Crawford et al.
2,881,770 A 4/1959 Touey
(Continued)

FOREIGN PATENT DOCUMENTS

EP 0 579 410 1/1994
WO WO 93/05868 4/1993
(Continued)

*Primary Examiner* — Jodi C Franklin
(74) *Attorney, Agent, or Firm* — Womble Carlyle Sandridge & Rice, LLP

(57) ABSTRACT

A filter element for use in a smoking article and providing filtration of particulate material and gaseous components of mainstream smoke is provided. The filter element includes a segment of fibrous tow comprising a plurality of individual filaments, wherein each individual filament includes a plurality of adsorbent material particles at least partially encapsulated with a removable encapsulant imbedded therein. The individual filaments may further include an outer coating that provides a plurality of reactive groups adapted for reaction with one or more components of mainstream smoke. Alternatively, the multifunctional filter element combines different fibrous filter materials, such as cellulose acetate or polyolefin filaments combined with activated carbon filaments and at least one of ion exchange filaments and catalytic filaments. A method of providing a cellulose acetate fibrous tow containing an imbedded adsorbent material is provided, wherein a plurality of encapsulated adsorbent particles are mixed with a cellulose acetate dope.

20 Claims, 4 Drawing Sheets

(51) Int. Cl.

| | |
|---|---|
| ***A24D 3/02*** | (2006.01) |
| ***A24D 3/08*** | (2006.01) |
| ***A24D 3/10*** | (2006.01) |
| ***A24D 3/16*** | (2006.01) |
| ***D01F 1/10*** | (2006.01) |
| ***D01F 2/28*** | (2006.01) |
| ***D01F 6/04*** | (2006.01) |
| ***D06M 10/04*** | (2006.01) |
| ***D06M 11/74*** | (2006.01) |
| ***D06M 11/77*** | (2006.01) |
| ***D06M 11/79*** | (2006.01) |
| ***D06M 15/233*** | (2006.01) |
| ***D06M 15/263*** | (2006.01) |
| ***D06M 15/41*** | (2006.01) |
| ***D06M 15/55*** | (2006.01) |
| ***D06M 23/08*** | (2006.01) |
| *D06M 16/00* | (2006.01) |

(52) U.S. Cl.

CPC ..... *D06M 15/233* (2013.01); *D06M 15/263* (2013.01); *D06M 15/41* (2013.01); *D06M 15/55* (2013.01); *D06M 23/08* (2013.01)

(56) References Cited

U.S. PATENT DOCUMENTS 2,953,838 A 9/1960 Crawford et al.
3,101,723 A 8/1963 Seligman et al.
3,217,715 A 11/1965 Berger et al.
3,236,244 A 2/1966 Irby, Jr. et al.
3,311,519 A 3/1967 Touey et al.
3,313,306 A 4/1967 Berger et al.
3,319,629 A 5/1967 Chamberlain
3,347,247 A 10/1967 Lloyd
3,349,780 A 10/1967 Sublett et al.
3,370,595 A 2/1968 Davis et al.
3,413,982 A 12/1968 Sublett et al.
3,424,172 A 1/1969 Neurath et al.
3,551,256 A 12/1970 Watson
3,602,231 A 8/1971 Dock
3,648,711 A 3/1972 Berger et al.
3,844,200 A 10/1974 Sexstone
3,904,577 A 9/1975 Buisson
3,957,563 A 5/1976 Sexstone
3,972,335 A 8/1976 Tiggelbeck et al.
4,016,830 A 4/1977 Sexstone
4,062,368 A * 12/1977 Crellin et al. ..... 131/332
4,174,720 A 11/1979 Hall
4,182,348 A * 1/1980 Seehofer et al. ..... 131/334
4,195,649 A * 4/1980 Noguchi et al. ..... 131/342
4,201,234 A 5/1980 Neukomm
4,214,508 A 7/1980 Washington
4,223,597 A 9/1980 Lebet
4,281,671 A 8/1981 Bynre et al.
4,317,460 A 3/1982 Dale et al.
4,379,465 A * 4/1983 Coq ..... 131/332
4,411,640 A 10/1983 Hall
4,425,107 A 1/1984 Hall
4,700,723 A * 10/1987 Yoshikawa et al. ..... 131/334
4,771,795 A 9/1988 White et al.
4,811,745 A 3/1989 Cohen et al.
4,876,078 A 10/1989 Arakawa et al.
4,925,602 A 5/1990 Hill et al.
4,947,874 A 8/1990 Brooks et al.
4,956,330 A 9/1990 Elliott et al.
5,027,837 A 7/1991 Clearman et al.
5,050,621 A 9/1991 Creighton et al.
5,137,034 A 8/1992 Perfetti et al.
5,225,277 A 7/1993 Takegawa et al.
5,230,960 A 7/1993 Iizuka
5,258,340 A 11/1993 Augustine et al.
5,268,158 A 12/1993 Paul, Jr.
5,271,419 A 12/1993 Arzonica et al.
5,275,859 A * 1/1994 Phillips et al. ..... 428/66.6
5,322,495 A 6/1994 Budjinski, II et al.
5,338,605 A 8/1994 Noland et al.
5,360,023 A 11/1994 Blakley
5,446,005 A 8/1995 Endo
5,482,773 A 1/1996 Bair
5,509,430 A 4/1996 Berger
5,536,486 A 7/1996 Nagata et al.
5,568,819 A 10/1996 Gentry et al.
5,622,190 A 4/1997 Arterbery et al.
5,909,736 A 6/1999 Stavridis et al.
6,136,246 A 10/2000 Rauwendaal et al.
6,194,036 B1 2/2001 Babayan et al.
6,209,547 B1 * 4/2001 Koller et al. ..... 131/331
6,503,475 B1 1/2003 McCormick et al.
6,537,186 B1 3/2003 Veluz
6,562,495 B2 5/2003 Yadav et al.
6,572,673 B2 6/2003 Lee et al.
6,584,979 B2 * 7/2003 Xue et al. ..... 131/344
6,615,842 B1 * 9/2003 Cerami et al. ..... 131/331
6,631,722 B2 * 10/2003 MacAdam et al. ..... 131/331
6,656,412 B2 12/2003 Ercelebi et al.
6,709,622 B2 3/2004 Billiet et al.
6,739,344 B2 5/2004 Yamashita
6,761,174 B2 7/2004 Jupe et al.
6,779,529 B2 * 8/2004 Figlar et al. ..... 131/334
6,789,547 B1 9/2004 Paine, III
6,789,548 B2 9/2004 Bereman
6,837,281 B2 1/2005 Spiers et al.
6,844,122 B2 1/2005 Haggquist
6,848,450 B2 2/2005 Lilly, Jr. et al.
6,907,885 B2 * 6/2005 Xue et al. ..... 131/202
6,913,784 B2 7/2005 Xue et al.
7,011,096 B2 3/2006 Li et al.
7,025,067 B2 4/2006 Chatterjee
7,115,085 B2 10/2006 Deal
7,152,609 B2 * 12/2006 Li et al. ..... 131/334
7,165,553 B2 1/2007 Luan et al.
7,223,376 B2 5/2007 Panter et al.
7,228,862 B2 6/2007 Hajaligol et al.
7,247,374 B2 * 7/2007 Haggquist ..... 428/403
7,300,394 B2 11/2007 Buhl et al.
7,370,657 B2 5/2008 Zhuang et al.
7,509,961 B2 3/2009 Saoud et al.
7,549,427 B2 6/2009 Dellinger et al.
7,552,735 B2 6/2009 Xue et al.
7,560,410 B2 7/2009 Pillai et al.
7,566,681 B2 7/2009 Bock et al.
7,585,441 B2 9/2009 Caenen et al.
7,610,920 B2 11/2009 Fournier et al.
7,784,470 B2 8/2010 Paine, III et al.
7,784,471 B2 8/2010 Paine, III et al.
7,806,817 B2 10/2010 Day et al.
2002/0194958 A1 * 12/2002 Lee et al. ..... 75/370
2003/0098030 A1 5/2003 Figlar et al.
2003/0213496 A1 11/2003 Wolff et al.
2004/0025895 A1 2/2004 Li et al.
2004/0074507 A1 * 4/2004 MacAdam et al. ..... 131/337
2004/0134631 A1 * 7/2004 Crooks et al. ..... 162/139
2004/0226569 A1 11/2004 Yang et al.
2004/0237984 A1 12/2004 Figlar et al.
2005/0066982 A1 3/2005 Clark et al.
2005/0126582 A2 * 6/2005 Dollhopf et al. ..... 131/331
2005/0133050 A1 * 6/2005 Fournier et al. ..... 131/207
2005/0133051 A1 6/2005 Luan et al.
2005/0133053 A1 6/2005 Fournier et al.
2005/0263163 A1 * 12/2005 Yadav et al. ..... 131/334
2005/0274390 A1 12/2005 Banerjee et al.
2006/0025292 A1 2/2006 Hicks et al.
2006/0124146 A1 * 6/2006 Stokes et al. ..... 131/365
2006/0144410 A1 * 7/2006 Luan et al. ..... 131/207
2006/0201524 A1 9/2006 Zhang et al.
2006/0231113 A1 10/2006 Newbery et al.
2007/0056600 A1 3/2007 Coleman, III et al.
2007/0068540 A1 3/2007 Thomas et al.
2007/0181141 A1 8/2007 Xue et al.
2007/0215168 A1 * 9/2007 Banerjee et al. ..... 131/335
2007/0251658 A1 11/2007 Gedevanishvili et al.
2007/0259124 A1 * 11/2007 Luan et al. ..... 427/427.7

(56) References Cited

U.S. PATENT DOCUMENTS

| | | | | |
|---|---|---|---|---|
| 2007/0261706 | A1 | 11/2007 | Banerjea et al. | |
| 2008/0029118 | A1 | 2/2008 | Nelson et al. | |
| 2008/0135060 | A1* | 6/2008 | Kuo et al. | 131/332 |
| 2008/0142028 | A1 | 6/2008 | Fagg | |
| 2008/0173320 | A1 | 7/2008 | Dunlap et al. | |
| 2008/0245376 | A1 | 10/2008 | Travers et al. | |
| 2008/0295853 | A1 | 12/2008 | Jones | |
| 2008/0302373 | A1 | 12/2008 | Stokes et al. | |
| 2009/0025736 | A1* | 1/2009 | Stewart et al. | 131/202 |
| 2009/0288667 | A1 | 11/2009 | Andresen et al. | |
| 2009/0288672 | A1 | 11/2009 | Hutchens | |
| 2010/0065075 | A1 | 3/2010 | Banerjee et al. | |
| 2010/0101589 | A1 | 4/2010 | Nelson et al. | |
| 2010/0122708 | A1 | 5/2010 | Sears et al. | |
| 2010/0125039 | A1* | 5/2010 | Banerjee et al. | 502/417 |
| 2010/0206317 | A1* | 8/2010 | Albino et al. | 131/88 |
| 2010/0236561 | A1 | 9/2010 | Barnes et al. | |
| 2010/0247582 | A1* | 9/2010 | Sorensen et al. | 424/400 |
| 2012/0000479 | A1 | 1/2012 | Sebastian et al. | |
| 2012/0325233 | A1* | 12/2012 | Wilson et al. | 131/345 |

FOREIGN PATENT DOCUMENTS

| | | |
|---|---|---|
| WO | WO 2006/051422 | 5/2006 |
| WO | WO 2006070291 A2 * | 7/2006 |
| WO | WO 2006/103404 | 10/2006 |

* cited by examiner

FILTER ELEMENT COMPRISING MULTIFUNCTIONAL FIBROUS SMOKE-ALTERING MATERIAL

CROSS-REFERENCE TO RELATED APPLICATIONS

This application is a divisional of U.S. application Ser. No. 12/847,228, filed Jul. 30, 2010, which is incorporated by reference herein in its entirety.

FIELD OF THE INVENTION

The present invention relates to products made or derived from tobacco, or that otherwise incorporate tobacco, and are intended for human consumption. In particular, the invention relates to filter elements for smoking articles such as cigarettes.

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain filter elements for cigarettes contain materials that alter the chemical composition or sensory characteristics of mainstream smoke. For example, it is known to incorporate certain adsorbent materials into a filter element, such as activated carbon or charcoal materials (collectively, carbonaceous materials) in particulate or granular form. Granules of carbonaceous material can be incorporated into "dalmatian" types of filter regions using the general types of techniques used for traditional dalmatian filter manufacture. Techniques for production of dalmatian filters are known, and representative dalmatian filters have been provided commercially by Filtrona Greensboro Inc. Alternatively, granules of carbonaceous material can be incorporated into "cavity" types of filter regions using the general types of techniques used for traditional "cavity" filter manufacture. Various types of filters incorporating charcoal particles or activated carbon types of materials are set forth in U.S. Pat. No. 2,881,770 to Touey; U.S. Pat. No. 3,101,723 to Seligman et al.; U.S. Pat. No. 3,236,244 to Irby et al.; U.S. Pat. No. 3,311,519 to Touey et al.; U.S. Pat. No. 3,313,306 to Berger; U.S. Pat. No. 3,319,629 to Chamberlain; U.S. Pat. No. 3,347,247 to Lloyd; U.S. Pat. No. 3,349,780 to Sublett et al.; U.S. Pat. No. 3,370,595 to Davis et al.; U.S. Pat. No. 3,413,982 to Sublett et al.; U.S. Pat. No. 3,551,256 to Watson; U.S. Pat. No. 3,602,231 to Dock; U.S. Pat. No. 3,904,577 to Buisson; U.S. Pat. No. 3,972,335 to Tigglebeck et al.; U.S. Pat. No. 5,360,023 to Blakley et al.; U.S. Pat. No. 5,909,736 to Stavridis; and U.S. Pat. No. 6,537,186 to Veluz; US Pat. Publication Nos. 2003/0034085 to Spiers et al.; 2003/0106562 to Chatterjee; 2005/0066982 to Clark et al; 2006/0025292 to Hicks et al.; 2007/0056600 to Coleman, III et al.; 2008/0142028 to Fagg; 2008/0173320 to Dunlap et al.; 2008/0295853 to Jones; 2009/0288672 to Hutchens; PCT WO 2006/064371 to Banerjea et al.; PCT WO 2006/051422 to Jupe et al.; and PCT WO2006/103404 to Cashmore et al., which are incorporated herein by reference.

Various methods and apparatuses have been developed to manufacture filter elements containing fibrous tow material combined with an adsorbent material or other particulate additive. For example, techniques for production of dalmatian filters are known, and representative dalmatian filters have been provided commercially by Filtrona Greensboro Inc. Carbon particles can be incorporated into cavity types of filter regions using the general types of techniques used for traditional cavity filter manufacture. See, for example, the types of equipment and techniques that can be used for, or suitably modified for use for, incorporating materials into filters that are set forth in U.S. Pat. No. 3,844,200 to Sexstone; U.S. Pat. No. 4,016,830 to Sexstone; U.S. Pat. No. 4,214,508 to Washington; U.S. Pat. No. 4,425,107 to Hall; U.S. Pat. No. 4,411,640 to Hall; U.S. Pat. No. 5,322,495 to Budjinski II et al; U.S. Pat. No. 5,656,412 to Ercelebi et al and U.S. Pat. No. 6,837,281 to Spiers et al.; which are incorporated herein by reference. Other arrangements for inserting objects into filter material are disclosed, for example, in U.S. Pat. No. 4,281,671 to Byrne et al. and U.S. Pat. No. 7,115,085 to Deal; US Pat. Appl. Pub. Nos. 2007/0068540 to Thomas et al.; 2008/0029118 to Nelson et al.; 2008/0142028 to Fagg; 2008/0302373 to Stokes et al; 2009/0288667 to Andresen et al.; 2009/0288672 to Hutchens and 2010/0101589 to Nelson et al.; and U.S. patent application Ser. No. 12/407,260, filed Mar. 19, 2009, which are incorporated herein by reference.

The currently available filter technology for incorporation of a particulate additive into a filter element suffers from several drawbacks. Cavity filters that include a particulate additive in a free state, such as activated carbon particles, could potentially result in contamination of mainstream smoke and can also suffer from channeling of smoke around the loose bed of particles in the cavity. In addition, manufacturing methods for incorporating particulate additives in cavity filters can be challenging due to particulate dust clouds created during the process. Affixing a particulate adsorbent within a fibrous tow typically involves use of a plasticizer or other adhesive material to adhere the particles within the fibrous mass, which can lead to deactivation of the adsorbent due to contamination of the surface of the particles by the plasticizer or adhesive.

There remains a need in the art for multifunctional filter elements that provide multiple different mechanisms for filtration of mainstream smoke, and which can be manufactured in a simple manner with minimal modification of existing filter manufacturing equipment and processes.

SUMMARY OF THE INVENTION

The present invention relates to a smoking article, and in particular, a rod shaped smoking article (e.g., a cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter rod. The filter rod comprises a multifunctional fibrous filter material capable of both particulate filtration and filtration of gas phase components of mainstream smoke without the need for adsorbent materials in a free particulate form.

In one aspect, the invention provides a filter element adapted for use in a smoking article and providing filtration of both particulate material and at least one gaseous component of mainstream smoke, the filter element comprising at least one segment of fibrous tow comprising a plurality of individual filaments (e.g., cellulose acetate or polyolefin filaments), wherein each individual filament comprises a plurality of adsorbent material particles at least partially encapsulated with a removable encapsulant imbedded therein. At least a portion of the encapsulated adsorbent material particles have a surface area portion exposed on the surface of said individual filament, and at least a portion of the exposed surface area portion is free of encapsulant. Each individual filament further comprises an outer coating comprising a plurality of reactive groups adapted for reaction with one or more components of mainstream smoke.

In certain embodiments, the removable encapsulant is an encapsulant removable by treatment with a solvent, exposure to a light source, or biodegradation. Exemplary encapsulants include surfactants, inorganic salts, polymer salts, polyvinyl alcohols, waxes, photo-reactive materials, biodegradable materials, ethoxylated acetylenic diols, and combinations thereof. Water-soluble encapsulants are particularly useful.

The imbedded adsorbent can vary, but is typically activated carbon, molecular sieves, clay, ion exchange resins, activated alumina, silica gel, meerschaum, or a combination thereof.

The continuous or discontinuous coating containing the reactive groups is typically applied using any coating technique known in the art, and in certain embodiments, the coating is deposited using a plasma treatment. Exemplary reactive groups include amino groups, nanoparticles, thiol groups, copper ions, and combinations thereof. However, any reactive group capable of direct reaction with, or catalysis of a reaction with, any Hoffmann analyte could be used in the invention. In certain embodiments, the reactive groups are adapted for reaction with at least one component selected from the group consisting of hydrogen cyanide, pyridine, quinoline, butadiene, toluidine, naphthylamine, carbon monoxide, nitric oxide, nitrogen dioxide, mercury, cadmium, methanol, isoprene, acetone, acrolein, methyl ethyl ketone, acrylonitrile, benzene, toluene, styrene, phenols, and aldehydes.

In another embodiment, the invention provides a filter element comprising at least one segment of cellulose acetate fibrous tow comprising a plurality of individual cellulose acetate filaments, wherein each individual filament comprises a plurality of activated carbon particles at least partially encapsulated with a removable encapsulant imbedded therein, and wherein at least a portion of the encapsulated activated carbon particles have a surface area portion exposed on the surface of said individual filament, and at least a portion of the exposed surface area portion is free of encapsulant.

In another aspect of the invention, the multifunctional fibrous filter element is provided by combining multiple fiber types, each having different filtration properties, in order to form a multifunctional composite filter element made predominately of, or substantially of, fibrous materials. In this aspect, the filter element typically comprises the following fibrous filter materials in the form of a fibrous tow:

a) cellulose acetate or polyolefin filaments;

b) activated carbon filaments; and c) at least one of ion exchange filaments and catalytic filaments.

The cellulose acetate or polyolefin filaments in this embodiment can be the treated multifunctional filaments described herein, meaning the filaments can include partially encapsulated adsorbent material particles and/or an outer coating comprising a plurality of reactive groups adapted for reaction with one or more components of mainstream smoke. All of the fibrous filter materials can be mixed in the same segment of fibrous tow, or one or more of the fibrous filter materials can be segregated in separate segments of fibrous tow. The filter element of the invention can be substantially free of adsorbent material in free particulate form, and more particularly, the fibrous filter materials are typically the only components of the filter element capable of filtration of gaseous components of mainstream smoke.

The invention also provides smoking articles comprising a tobacco rod comprising a smokable filler material contained within a circumscribing wrapping material and attached to any of the filter element embodiments set forth herein.

In yet another aspect, the invention provides a method of providing a cellulose acetate fibrous tow containing an imbedded adsorbent material. The method includes the steps of treating a particulate adsorbent material with an encapsulant to produce encapsulated adsorbent particles; mixing a plurality of encapsulated adsorbent particles with a cellulose acetate dope comprising cellulose acetate dissolved in a liquid solvent; spinning the cellulose acetate dope into filaments having encapsulated adsorbent particles imbedded therein; and removing at least a portion of the encapsulant from the encapsulated adsorbent particles imbedded in the filaments such that at least a portion of the adsorbent particles have a surface area portion exposed on the surface of the filaments. The removable encapsulant is typically soluble in a solvent, such as water, supercritical carbon dioxide, or liquid nitrogen, and the removing step would then entail treating the filaments with the solvent.

The method can further include coating the outer surface of the filaments with a coating comprising a plurality of reactive groups adapted for reaction with one or more components of mainstream smoke (e.g., using a plasma treatment), wherein the coating step occurs either before or after the removing step. The method can also include one or more additional steps including collecting the filaments in a tow band, forming a fibrous tow filter segment using the tow band, and attaching the fibrous tow filter segment to a tobacco rod to form a smoking article.

BRIEF DESCRIPTION OF THE DRAWINGS

In order to assist the understanding of embodiments of the invention, reference will now be made to the appended drawings, which are not necessarily drawn to scale. The drawings are exemplary only, and should not be construed as limiting the invention.

DETAILED DESCRIPTION OF THE PREFERRED EMBODIMENTS

The present invention now will be described more fully hereinafter with reference to the accompanying drawings. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

The invention provides fibrous filter materials for use in filter elements of smoking articles that provide multifunctional filtration properties, meaning the fibrous filter materials are capable of filtering mainstream smoke from a smoking article using a combination of filtration mechanisms selected from particulate filtration and filtration of various gas phase components of mainstream smoke. The combined filtration properties are provided by combining multiple different fiber types in the same filter element or by processing a single fiber type in a manner that enables the fiber to filter mainstream smoke through multiple different mechanisms. The invention provides multifunctional filtration properties without the need for adsorbent materials in a free particulate form, meaning adsorbent particles capable of free movement and arranged in a cavity or simply placed between fibers in a fibrous tow (i.e., without imbedding the particles within the individual filaments). In preferred embodiments, the filter elements of the invention are substantially free of adsorbent materials in free particulate form and more preferably completely free of such materials. Exemplary embodiments of the invention include less than about 0.5 weight percent adsorbent materials in free particulate form, and more typically less than about 0.1 weight percent of such materials, based on the total weight of the filter element.

Figure 1:
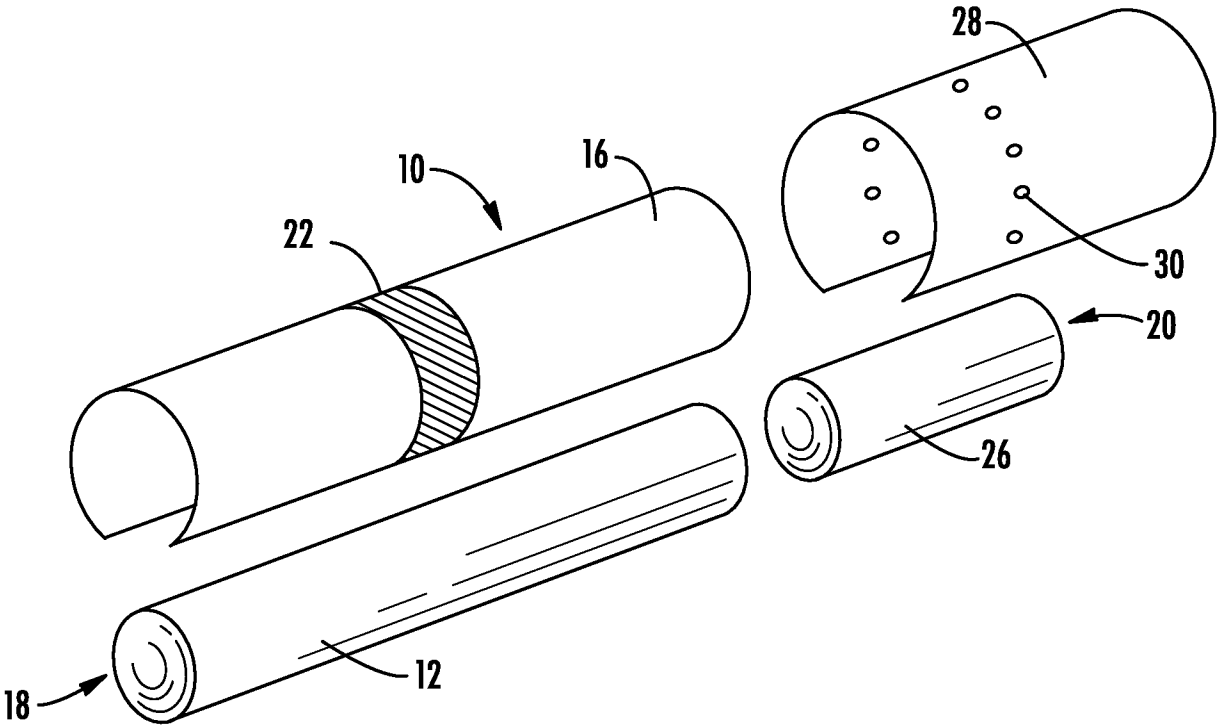
FIG. 1 is an exploded perspective view of a smoking article having the form of a filtered cigarette, showing the smokable material, the wrapping material components, and the filter rod of the cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter rod 26. The filter rod 26 is positioned adjacent one end of the tobacco rod 12 such that the filter rod and tobacco rod are axially aligned in an end-to-end relationship, preferably abutting one another. Filter rod 26 may have a generally cylindrical shape, and the diameter thereof may be essentially equal to the diameter of the tobacco rod. The ends of the filter rod 26 permit the passage of air and smoke therethrough. According to the invention, the filter rod 26 includes a multifunctional fibrous filter material of the type described herein.

A ventilated or air diluted smoking article can be provided with an optional air dilution means, such as a series of perforations 30, each of which extend through the tipping material 40 (see FIGS. 3 and 4) and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper).

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of mainstream tobacco smoke) generated by the burning smokable material 12 are drawn through the cigarette 10, through the filter rod 26, and into the mouth of the smoker. During draw, certain amounts of particulate and gaseous components of the mainstream smoke are removed by the filter element containing the multifunctional fibrous filter material of the invention.

In a first aspect, the invention provides a fiber for use in smoking article filter elements wherein a particulate adsorbent material is imbedded within the filament structure and the outer surface of the fiber is optionally further processed in a manner that provides a plurality of reactive groups adapted for reaction with one or more gaseous components of mainstream smoke. Such a fiber can be processed to produce a fibrous tow segment for a filter element of a smoking article, such as the filter element segments illustrated in FIGS. 3 and 4. The resulting fibrous tow segment will provide both filtration of particulate material, by virtue of the fiber being provided in the form of a fibrous tow, and filtration of at least one gaseous component of mainstream smoke. The gas phase filtration properties are provided by both the imbedded adsorbent and the surface reactivity of the fiber. In this manner, a fibrous tow can be created with multifunctional filtration properties and without the need for free-flowing particulate materials that can complicate manufacturing processes.

The fiber material that is processed to create the multifunctional filtration characteristics can be any fiber material suitable for formation into a fibrous tow mass conventionally used in cigarette manufacture. Cellulose acetate and polyolefin (e.g., polypropylene) fibers are particularly well-suited for the invention. Especially preferred is filamentary or fibrous tow such as cellulose acetate, polyolefins such as polypropylene, or the like. The fibrous tow in any given filter element segment can vary in denier per filament (i.e., dpf where denier is expressed in units of g/9000 m) and total denier. Denier per filament is a measurement of the weight per unit length of the individual filaments of the tow, and can be manipulated to achieve a desired pressure drop across the filter segment. An exemplary dpf range for the fibrous tow used in the filter element of the invention is about 1.5 to about 8. An exemplary range of total denier for fibrous tow used in the present invention is about 10,000 to about 50,000 (e.g., about 15,000 or about 40,000 total denier). For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

Filamentary tow, such as cellulose acetate, is processed using a conventional filter tow processing unit such as a commercially available E-60 supplied by Arjay Equipment Corp., Winston-Salem, N.C. Other types of commercially available tow processing equipment, as are known to those of ordinary skill in the art, may similarly be used.

As used herein, "adsorbent material" refers to any material capable of changing the chemical composition of mainstream smoke through physical or chemical sorption of gaseous components of mainstream smoke. Certain useful adsorbent materials are materials with relatively high surface area capable of adsorbing smoke constituents with or without a high degree of specificity. Exemplary types of adsorbent material may include activated carbon, a molecular sieve (e.g., zeolites and carbon molecular sieves), clay, an ion exchange resin, activated alumina, silica gel, meerschaum, and combinations thereof. The form of the adsorbent material can vary, but is typically granular. In one embodiment, the adsorbent material has a particle size of about 10 Mesh to about 400 Mesh, more preferably about 30 Mesh to about 200 Mesh.

A preferred adsorbent is a carbonaceous material, such as an activated carbon material. Exemplary activated carbon materials have surface areas of more than about 200 $m^2/g$, often more than about 1000 $m^2/g$, and frequently more than about 1500 $m^2/g$, as determined using the Brunaver, Emmet and Teller (BET) method described in J. Amer. Chem. Soc., Vol. 60(2), pp. 309-319 (1938). Suitable examples of such carbonaceous materials are disclosed, for example, in EP 913100 to Jung et al.; WO 2008/043982 to Tennison et al.; WO 2007/104908 to White et al.; WO 2006/103404 to Cashmore et al.; and WO 2005/023026 to Branton et al.; and U.S. Pat. No. 7,370,657 to Zhuang et al., which are incorporated by reference herein.

Activated carbon can be derived from synthetic or natural sources. Materials such as rayon or nylon can be carbonized, followed by treatment with oxygen to provide activated carbonaceous materials. Materials such as wood or coconut shells can be carbonized, followed by treatment with oxygen to provide activated carbonaceous materials. The level of activity of the carbon may vary. Typically, the carbon has an activity of about 60 to about 150 Carbon Tetrachloride Activity (i.e., weight percent pickup of carbon tetrachloride). Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, AMBERSORB 572 or AMBERSORB 563 resins available from Rohm and Haas, and various activated carbon materials available from Prominent Systems, Inc. See, also, for example, Activated Carbon Compendium, Marsh (Ed.) (2001), which is incorporated herein by reference.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. No. 3,217,715 to Berger et al.; U.S. Pat. No. 3,648,711 to Berger et al.; U.S. Pat. No. 3,957,563 to Sexstone; U.S. Pat. No. 4,174,720 to Hall; U.S. Pat. No. 4,201,234 to Neukomm; U.S. Pat. No. 4,223,597 to Lebert; U.S. Pat. No. 4,771,795 to White, et al.; U.S. Pat. No. 5,027,837 to Clearman, et al.; U.S. Pat. No. 5,137,034 to Perfetti et al.; U.S. Pat. No. 5,360,023 to Blakley et al.; U.S. Pat. No. 5,568,819 to Gentry et al.; U.S. Pat. No. 5,622,190 to Arterbery et al.; U.S. Pat. No. 6,537,186 to Veluz; U.S. Pat. No. 6,584,979 to Xue et al.; U.S. Pat. No. 6,761,174 to Jupe et al.; U.S. Pat. No. 6,789,547 to Paine III; and U.S. Pat. No. 6,789,548 to Bereman; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al.; 2006/0180164 to Paine, III et al.; and 2007/0056600 to Coleman, III et al.; European Pat. Appl. 579410 to White; and PCT WO 2006/064371 to Banerjea et al.; which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc.

Exemplary ion exchange resins comprise a polymer backbone, such as styrene-divinylbenzene (DVB) copolymers, acrylates, methacrylates, phenol formaldehyde condensates, and epichlorohydrin amine condensates, and a plurality of electrically charged functional groups attached to the polymer backbone, and can be a weak base anion exchange resin or a strong base anion exchange resin. Commercially available embodiments of such resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China. See also the various adsorbent materials set forth in U.S. Pat. No. 6,779,529 to Figlar et al., which is incorporated by reference herein.

Typically, the amount of adsorbent material (e.g., carbonaceous material) within the fiber element is at least about 10 mg, often at least about 15 mg, and frequently at least about 20 mg, on a dry weight basis. Typically, the amount of carbonaceous material or other adsorbent material within the filter element does not exceed about 500 mg, generally does not exceed about 400 mg, often does not exceed about 300 mg, and frequently does not exceed about 150 mg, on a dry weight basis.

As noted above, a particulate adsorbent material is imbedded into the fiber construction, meaning the adsorbent particles are dispersed within the individual filament structure, but with some portion of the particles exposed on the surface of the fiber so that the particles can interact with mainstream smoke. The adsorbent particles are introduced into the fiber material by mixing the particles with the fiber composition prior to fiber extrusion. However, deactivation of the adsorbent particles can be caused by interaction between the particles and the fiber material or other chemical additives used in the fiber-making process, or by processing conditions experienced during the fiber manufacturing process.

To avoid this result, it is preferable to treat the adsorbent materials with an encapsulant prior to introduction of the particles into the fiber material. The encapsulant can be selected from, but is not limited to, surfactants (e.g., water-soluble surfactants), inorganic salts (e.g., sodium chloride, calcium chloride), polymer salts, polyvinyl alcohols, waxes (e.g., paraffin, carnauba), photo-reactive materials, degradable materials, biodegradable materials, ethoxylated acetylenic diols, and any other suitable substances or combinations of the foregoing. Specific examples of such encapsulants include SURFYNOL 485W, 485, 2502, and 465 water soluble surfactants, sold by Air Products and Chemicals Corporation, of Allentown, Pa., waxes sold as TEXTILE WAX-W and SIZE SF-2, by BASF Corporation, of Charlotte, N.C., and waxes sold as model numbers KINCO 878-S and KINCO 778-H by Kindt-Collins Company, of Cleveland, Ohio. The encapsulant can be applied to the adsorbent particles in any known manner, such as by spray-coating the particles or mixing the particles with a bath of encapsulant. Following treatment of the particles with encapsulant, the adsorbent particles can be added to the fiber material and processed into fibers by extrusion.

At some point thereafter, at least a portion of the encapsulant can be removed from the particles, particularly from at least part of the surface area of the particles exposed on the fiber surface. Removal of the encapsulant, or a portion thereof, can be accomplished by using encapsulant materials that are soluble in certain solvents. For example, the encapsulant may be soluble in different types of solvents such as water (e.g., steam), supercritical $CO_2$, liquid nitrogen, and the like. In another embodiment, a light source (e.g., incandescent, ultra-violet, infra-red, etc.) can be used to remove the encapsulant from the active particles. In yet another embodiment, biological materials can be used to remove biodegradable encapsulants. Exemplary encapsulants and methods of using and removing encapsulants from a material are set forth in U.S. Pat. No. 7,247,374 to Haggquist, which is incorporated by reference herein.

For purposes of illustration, the process for incorporating encapsulated adsorbent materials into a fiber will be described in connection with a cellulose acetate fiber production process, although the invention could be adapted for use with other fiber materials. The first step in conventional cellulose acetate fiber formation is esterifying a cellulose material. Cellulose is a polymer formed of repeating units of anhydroglucose. Each monomer unit has three hydroxyl groups available for ester substitution (e.g., acetate substitution). Cellulose esters may be formed by reacting cellulose with an acid anhydride. To make cellulose acetate, the acid anhydride is acetic anhydride. Cellulose pulp from wood or cotton fibers is typically mixed with acetic anhydride and acetic acid in the presence of an acid catalyst such as sulfuric acid. The esterification process of cellulose will often result in essentially complete conversion of the available hydroxyl groups to ester groups (e.g., an average of about 2.9 ester groups per anhydroglucose unit). Following esterification, the polymer is typically hydrolyzed to drop the degree of substitution (DS) to about 2 to about 2.5 ester groups per anhydroglucose unit. The resulting product is typically produced in flake form that can be used in subsequent processing.

To form a fibrous material, the cellulose acetate flake is typically dissolved in a solvent (e.g., acetone, methanol, methylene chloride, or mixtures thereof) to form a viscous solution. The concentration of cellulose acetate in the solution is typically about 15 to about 35 percent by weight. Additives such as whitening agents (e.g., titanium dioxide) can be added to the solution if desired. The resulting liquid is sometimes referred to as a liquid "dope."

Thereafter, the cellulose acetate dope is spun into filaments by extruding the liquid through a spinnerette. The filaments pass through a curing/drying chamber, which solidifies the filaments prior to collection. The collected fibers are typically combined into a tow band, crimped, and dried. Conventional crimp ratios are in the range of 1.2 to 1.8. The fibers are typically packaged in bales that are suitable for later use in filter element formation processes.

The process of forming the actual filter element typically involves mechanically withdrawing the cellulose acetate tow from the bale and separating the fibers into a ribbon-like band. The tow band is subjected to a "blooming" process wherein the tow band is separated into individual fibers. Blooming can be accomplished, for example, by applying different tensions to adjacent sections of the tow band or applying pneumatic pressure. The bloomed tow band then passes through a relaxation zone that allows the fibers to contract, followed by passage into a bonding station. The bonding station typically applies a plasticizer such as triacetin to the bloomed fibers, which softens the fibers and allows adjacent fibers to fuse together. The bonding process forms a homogenous mass of fibers with increased rigidity. The bonded tow is then wrapped in plug wrap and cut into filter rods. Cellulose acetate tow processes are set forth, for example, in U.S. Pat. No. 2,953,838 to Crawford et al.; U.S. Pat. No. 2,794,239 to Crawford et al.; U.S. Pat. No. 5,509,430 to Berger; and U.S. Pat. No. 7,585,441 to Caenen et al.; and US Patent Publication Nos. 2007/0272261 to Day et al. and 2008/0245376 to Travers et al., which are incorporated by reference herein.

In the present invention, the encapsulated adsorbent particles could be introduced into the cellulose acetate or polyolefin "dope" prior to spinning the cellulose acetate or polyolefin fibers. In other words, the particles are admixed into the fiber precursor solution. In such an embodiment, the particles are preferably insoluble in the dope solvent (e.g., acetone) and instead form a slurry or dispersion in the liquid composition. Still further, the adsorbent particles could be dry-blended with the polymer (e.g., polypropylene or cellulose acetate) prior to fiber formation, such as by using a twin-screw extruder conventionally used to mix additives with polymeric materials. U.S. Pat. No. 6,136,246 to Rauwendaal et al., which is incorporated by reference herein, discloses an exemplary screw extruder that could be used to mix particles with a polymer material prior to fiber formation. One advantage of incorporating the particles into the fibers prior to, or during, fiber formation is that each individual fiber that forms the fibrous tow filter material will have a plurality of particles dispersed and imbedded therein. The amount of encapsulated adsorbent particles added to the fiber precursor solution or admixed with a polymeric material using a dry-blending technique is typically in the range of about 5 to about 50% by weight, more often about 10 to about 30% by weight, based on the total weight of the precursor solution or total weight of the blended components.

Removal of the encapsulant can occur at any time after fiber formation. The removal step will typically involve direct exposure of the fibers to a solvent that dissolves the encapsulant material. For example, removal could be accomplished by passing the fibers through a steam chamber or a hot water bath for encapsulant materials soluble in water. The amount of encapsulant removed during the removal step will depend on a variety of factors including the type of encapsulant, the type of solvent, and the rigorousness of the removal process (e.g., presence or absence of agitation during dissolution, the temperature of the solvent, etc.). In certain embodiments, the removal step is sufficient to remove at least a portion of the encapsulant from the exposed surface of the adsorbent materials present on the surface of the fiber. Typically, the removal step primarily removes the encapsulant exposed to the exterior surface of the fiber and the remainder of the encapsulant remains in the fiber. The amount of removed encapsulant is often about 25% to about 99% of the encapsulant overlying the exposed surface of the adsorbent particles present on the exterior surface of the fiber.

Although less preferred, the adsorbent particles, whether in encapsulated form or not, could also be printed onto the fiber surface using xerographic techniques of the type set forth in U.S. Pat. No. 6,844,122 to Haggquist, which is incorporated by reference herein.

As noted above, in addition to incorporation of adsorbent particles, the individual filaments used in this embodiment of the invention are also optionally treated in order to introduce a plurality of reactive groups adapted for reaction with one or more gas phase components of mainstream smoke onto the surface of the filament. The reactive groups can vary, but preferred reactive groups are capable of reaction with, or catalysis of a reaction with, one or more so-called Hoffmann analytes present in mainstream smoke, a list of which is set forth in US Patent Publication No. 2008/0245376 to Travers et al., which is incorporated by reference herein. Exemplary gas phase components that are reaction targets for reactive groups present on the fiber include hydrogen cyanide, pyridine, quinoline, phenol, acetaldehyde, methanol, isoprene, acetone, acrolein, and various aldehydes (e.g., propionaldehyde, crotonaldehyde, and butyraldehyde), methyl ethyl ketone, 1,3-butadiene, acrylonitrile, benzene, toluene and styrene.

Exemplary reactive groups include amino groups (e.g., as part of an aminopropylsilyl group), nanoparticles (e.g., particles having an average particle size of less than a micron such as various metal oxides), thiol groups (e.g., in the form of a thioalkyltriethoxysilane covalently bound to a sorbent particle such as a silicate), copper ions (e.g., in the form of a copper-exchanged molecular sieve), and combinations thereof. Each of the above noted functional or reactive groups are capable of interacting with different components of mainstream smoke. More particularly, amine groups are believed to react with aldehydes and hydrogen cyanide, copper ions are believed to catalyze conversion of nitric oxide and nitrogen dioxide to molecular nitrogen, thiol groups are believed to remove mercury and cadmium, and nanoparticles are believed to catalyze conversion of carbon monoxide to carbon dioxide and/or reduce aldehydes, butadiene, isoprene, acrolein, hydrogen cyanide, toluidine, naphthylamine, nitric oxide, benzene, and/or phenols. Exemplary nanoparticle metal oxides include iron oxide, copper oxide, cerium oxide, titanium oxide, aluminum oxide, and doped metal oxides such as yttrium oxide doped with zirconium or manganese oxide doped with palladium. Certain reactive groups suitable for use in the invention are set forth in U.S. Pat. No. 6,209,547 to Koller et al. and U.S. Pat. No. 7,011,096 to Li et al.; and US Patent Publication Nos. 2004/0025895 to Li et al.; 2005/0133050 to Fournier et al.; and 2005/0133053 to Fournier et al.; which are incorporated by reference herein.

Individual fibers could be created with unique filtration properties tailored to a specific end use by combining different reactive groups in the same fiber so that various targeted components of mainstream smoke can be removed by the same filtration media. For example, a fibrous tow could be formed from fibers surface-treated with available amine groups for removal of hydrogen cyanide and available copper ions for conversion of nitric oxide.

The manner in which reactive groups are integrated into the surface of the fiber can vary. Reactive groups can be introduced to the fiber surface by the addition of co-monomers, or other additives bearing reactive groups, to the fiber material prior to extrusion (e.g., adding additives bearing reactive groups to a cellulose acetate dope), or by adding the reactive additive to the fiber following extrusion. For example, an additive containing the desired reactive group could be dissolved in a solvent or used in the form of a slurry and either sprayed onto the fiber surface or placed in a bath through which the fiber is passed. The manner of attaching the reactive groups to the fiber surface can include both chemisorption and physisorption techniques. Exemplary methods for incorporating additives into cellulose acetate fibers during the fiber formation process are set forth in US Patent Publication No. 2008/0245376 to Travers et al.

In another embodiment, the reactive groups are attached to the surface of the fiber using a plasma process, such as an atmospheric plasma process of the type conducted on low pressure plasma units available from Dow Corning Plasma Solutions. A plasma process involves passing the fiber through a plasma chamber and exposing the fiber surface to the plasma in the chamber. A liquid or gaseous reactive group precursor is also introduced into the plasma chamber through, for example, a nebulizer. The plasma treatment results in attachment of reactive groups to the fiber surface. Since certain plasma processes may deactivate activated carbon particles, the plasma treatment process can proceed prior to removal of the encapsulant so that the encapsulant is present to protect the particles from the plasma treatment. An exemplary atmospheric pressure plasma jet suitable for use in the invention is set forth in U.S. Pat. No. 6,194,036 to Babayan et al. and US Patent Publication No. 2009/0202739 to O'Neill et al., which are incorporated by reference herein.

Regardless of the technique employed, the resulting fiber will have a continuous or discontinuous coating that provides the desired reactive groups on its surface. The amount of the coating on the fiber surface can vary, but the coating will typically comprise about 0.5 to about 40 percent by weight, based on the total weight of the coated fiber, more often about 1.0 to about 15 percent by weight. The coated fiber can then be utilized in a smoking article filter using conventional techniques, such as by forming the coated fiber into a fibrous tow.

Figure 2:
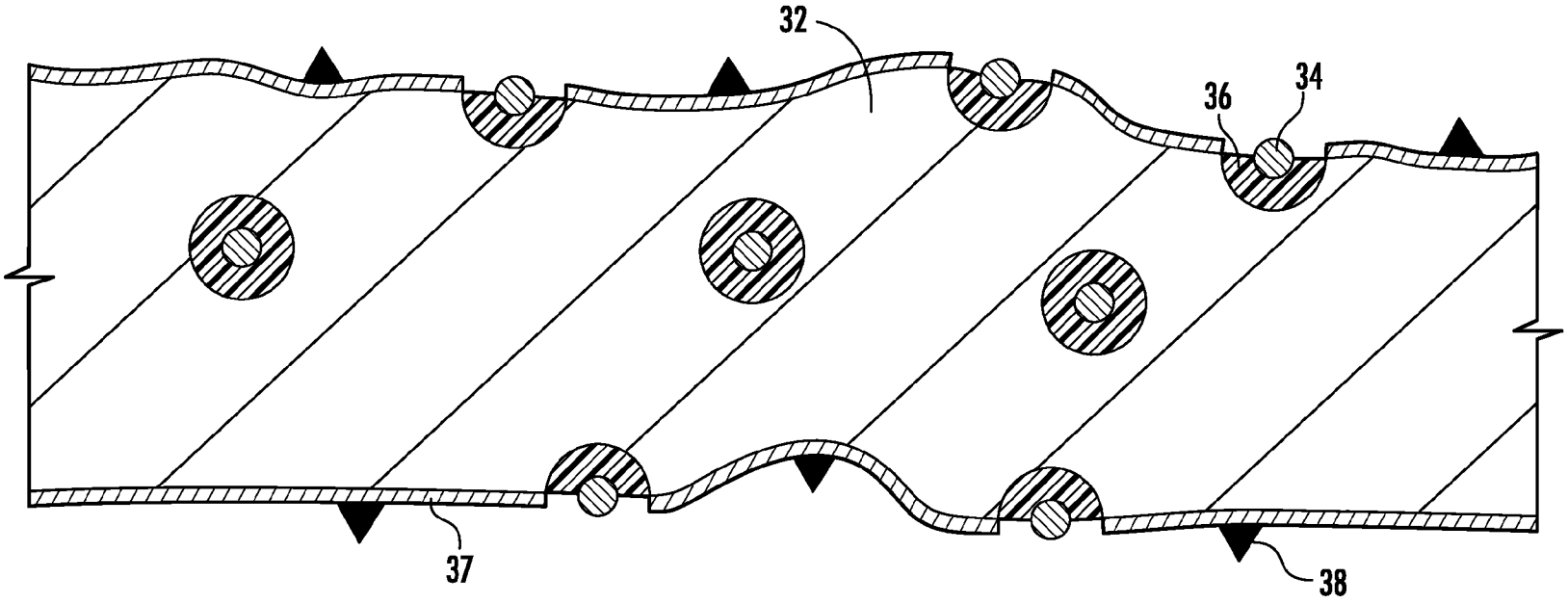
FIG. 2 is a cross-sectional view of a multifunctional fiber suitable for use in one embodiment of the invention.

FIG. 2 illustrates a cross-sectional view of an exemplary fiber 32 according to the above embodiment of the invention. The fiber 32 includes adsorbent particles 34 imbedded in the fiber structure, with some of the particles being encapsulated by an encapsulant 36. As shown, a portion of the encapsulant 36 has been removed from the particles 34 present on the surface of the fiber 32, and as a result, the particles on the surface of the fiber have at least a portion of their surface area exposed and capable of interacting with mainstream smoke passing through a filter element made using the fiber. The fiber 32 is also coated with a reactive coating material 37 that provides reactive groups 38 on the surface of the fiber. The base fiber material for fiber 32 can vary, but is typically cellulose acetate or polypropylene.

In another aspect of the invention, the multifunctional fiber discussed above is replaced or supplemented with additional types of fibers capable of providing a multifunctional fibrous filter material for use with smoking articles. The alternative approach involved combining fibers with different filtration properties in the same filter element. More particularly, the approach involved combining two or more of the following: carbon fibers, ion exchange fibers, and catalytic fibers. In this aspect of the invention, it is possible to provide a filter element where all filtration functionality is provided by fibrous materials, meaning the filter element is constructed predominately or completely from fibers as opposed to particulate adsorbent materials.

The amount of each fiber type in the filter element can vary, but typically each fiber type is present in an amount from about 10 percent by weight to about 90 percent by weight, based on the total combined weight of all fibrous materials in the filter element. More often, each fiber type is present in an amount of about 20 weight percent to about 50 weight percent. In one embodiment, each fiber type is present in approximately equal parts by weight.

The manner in which the fiber types are combined can vary, but a preferred approach involved combining filaments of each fiber type in a fibrous tow mixture using conventional techniques for forming cigarette filters. This approach allows the multifunctional fiber to be constructed using conventional filter tow equipment with little or no modification. Alternatively, one or more of the fiber types can be added to a fibrous tow as a dispersed additive, such as an additive in the form of short staple fibers, or added as a composite fiber adhered to or enwrapping a carrier fiber of a different type. See, for example, the types of equipment and techniques that can be used for, or suitably modified for use for, incorporating materials into filters that are set forth in U.S. Pat. No. 3,844,200 to Sexstone; U.S. Pat. No. 4,016,830 to Sexstone; U.S. Pat. No. 4,214,508 to Washington; U.S. Pat. No. 4,425,107 to Hall; U.S. Pat. No. 4,411,640 to Hall; U.S. Pat. No. 5,322,495 to Budjinski II et al; U.S. Pat. No. 5,656,412 to Ercelebi et al and U.S. Pat. No. 6,837,281 to Spiers et al.; which are incorporated herein by reference. Other arrangements for inserting objects into filter material are disclosed, for example, in U.S. Pat. No. 7,115,085 to Deal; US Pat. Appl. Pub. Nos. 2007/0068540 to Thomas et al.; 2008/0029118 to Nelson et al.; 2008/0142028 to Fagg; 2008/0302373 to Stokes et al; 2009/0288667 to Andresen et al.; 2009/0288672 to Hutchens; and 2010/0101589 to Nelson et al.; and U.S. patent application Ser. No. 12/407,260, filed Mar. 19, 2009, which are incorporated herein by reference.

Carbon fibers can be described as fibers obtained by the controlled pyrolysis of a precursor fiber. Since carbon is typically difficult to shape into fiber form, commercial carbon fibers are often made by extrusion of a precursor material into filaments, which is followed by carbonization, usually at high temperature. Common precursors for carbon fibers include rayon, acrylic fibers (such as polyacrylonitrile or PAN), and pitch (which can include isotropic pitch and anisotropic mesophase pitch, as well as meltblown pitch fibers). Other precursors, such as cellulose, may also be converted to carbon fibers. Many activated carbon fibers, because of their inherently larger surface areas, are capable of equal or higher activity per gram as compared with the granular carbons employed in prior art cigarette filters.

KYNOL™ novoloid fibers (available from American Kynol, Inc., Pleasantville, N.Y.), are high-performance phenolic fibers that are transformed into activated carbon by a one-step process combining both carbonization and activation. Foaming carbon fibers from rayon or acrylics generally consists of stabilization, carbonization, and graphitization, each taking place at successively higher temperatures, to sufficiently remove non-carbon species, such as oxygen, nitrogen, and hydrogen. Preparation of fibers using pitch also typically includes stabilization and carbonization; however, pitch is typically spun as part of the carbon fiber forming process, whereas pre-formed fibers from rayon or acrylics can be used directly. Activation can sometimes add yet further production steps. Sources of carbon fibers include Toray Industries, Toho Tenax, Mitsubishi, Sumitomo Corporation, Hexcel Corp., Cytec Industries, Zoltek Companies, and SGL Group. Exemplary commercially available carbon fibers include ACF-1603-15 and ACF-1603-20 available from American Kynol, Inc.

Carbon fibers are often classified in three separate ways. First, they can be classified based on modulus and strength. Examples include ultra high modulus (UHM) fibers (modulus>450 Gpa); high modulus (HM) fibers (modulus between 350 and 450 Gpa); intermediate modulus (IM) fibers (modulus between 200 and 350 Gpa); low modulus, high tensile (HT) fibers (modulus<100 Gpa and tensile strength>3.0 Gpa); and super high tensile (SHT) fibers (tensile strength>4.5 Gpa). Second, carbon fibers can be classified based on the precursor material used to prepare the fiber (e.g., PAN, rayon, pitch, mesophase pitch, isotropic pitch, or gas phase grown fibers). Third, carbon fibers can be classified based on the final heat treatment temperature. Examples include Type-I, high heat treatment (HTT) fibers (final heat treatment temperature above 2,000° C.), Type-II, intermediate heat treatment (IHT) fibers (final heat treatment temperature around 1,500° C.), and Type-III low heat treatment (LHT) fibers (final heat treatment not greater than 1,000° C.). Any of the above classifications of carbon fibers could be used in the present invention.

The carbon fibers may be partially carbonized, in which only the outer surface of the fiber is carbonized. These may be referred to as bi-regional fibers, and are available from Carbtex Corporation of Angleton, Tex.

Examples of starting materials, methods of preparing carbon-containing fibers, and types of carbon-containing fibers are disclosed in U.S. Pat. No. 3,319,629 to Chamberlain; U.S. Pat. No. 3,413,982 to Sublett et al.; U.S. Pat. No. 3,904,577 to Buisson; U.S. Pat. No. 4,281,671 to Bynre et al.; U.S. Pat. No. 4,876,078 to Arakawa et al.; U.S. Pat. No. 4,947,874 to Brooks et al.; U.S. Pat. No. 5,230,960 to Iizuka; U.S. Pat. No. 5,268,158 to Paul, Jr.; U.S. Pat. No. 5,338,605 to Noland et al.; U.S. Pat. No. 5,446,005 to Endo; U.S. Pat. No. 5,482,773 to Bair; U.S. Pat. No. 5,536,486 to Nagata et al.; U.S. Pat. No. 5,622,190 to Arterbery et al.; and U.S. Pat. No. 7,223,376 to Panter et al.; and U.S. Pat. Publication Nos. 2003/0200973 to Xue et al.; 2006/0201524 to Zhang et al. and 2006/0231113 to Newbery et al., all of which are incorporated herein by reference. Disclosure around PAN-based carbon fibers particularly (including manufacturers thereof) is provided in the report to congress entitled "Polyacrylonitrile (PAN) Carbon Fibers Industrial Capability Assessment: OUSD(AT&L) Industrial Policy" (October 2005), available on-line at http://www.acq.osd.mil/ip/docs/pan_carbon_fiber_report_to_congress__10-2005.pdf, which is incorporated herein by reference.

Ion exchange fibers are fibers capable of ion exchange with gas phase components of mainstream smoke from a smoking article. Such fibers are typically constructed by imbedding particles of an ion exchange material into the fiber structure or coating the fiber with an ion exchange resin. The amount of ion exchange material present in the fiber can vary, but is typically about 10 to about 50 percent by weight, based on the total weight of the ion exchange fiber, more often about 20 to about 40 percent by weight. Exemplary ion exchange fibers are described in U.S. Pat. No. 3,944,485 to Rembaum et al. and U.S. Pat. No. 6,706,361 to Economy et al, both of which are incorporated by reference herein. Ion exchange fibers are commercially available from Fiban of Belarus. Exemplary products from Fiban include FIBAN A-1 (monofunctional strong base fiber with $—N^+(CH_3)_3Cl^-$ functional group), FIBAN AK-22-1 (polyfunctional fiber with ═N, ═NH, and —COOH functional groups), FIBAN K-1 (monofunctional strong acid fiber with $—SO^{3-}H^+$ functional group), FIBAN K-3 (polyfunctional fiber with —COOH, $—NH_2$, and ═NH functional groups), FIBAN K-4 (monofunctional weak acid fiber with —COOH functional group), FIBAN X-1(iminodiacetic fiber) FIBAN K-1-1 (strong acid fiber similar to FIBAN K-1 modified by potassium-cobalt-ferrocyanide), FIBAN A-5 (polyfunctional fiber with $—N(CH_3)_2$, ═NH, and —COOH functional groups), FIBAN A-6 and A-7 (polyfunctional fiber with strong and weak base amine groups), FIBAN AK-22B (polyfunctional fiber similar to FIBAN K-3), and FIBAN S (monofunctional fiber with $[FeOH]^{2+}$ functional group).

Catalytic fibers are fibers capable of catalyzing the reaction of one or more gas phase components of mainstream smoke, thereby reducing or eliminating the presence of the gas phase component in the smoke drawn through the filter element. Exemplary catalytic fibers catalyze oxidation of one or more gaseous species present in mainstream smoke, such as carbon monoxide, nitrogen oxides, hydrogen cyanide, catechol, hydroquinone, or certain phenols. The oxidation catalyst used in the invention is typically a catalytic metal compound (e.g., metal oxides such as iron oxides, copper oxide, zinc oxide, and cerium oxide) that oxidizes one or more gaseous species of mainstream smoke. Exemplary catalytic metal compounds are described in U.S. Pat. No. 4,182,348 to Seehofer et al.; U.S. Pat. No. 4,317,460 to Dale et al.; U.S. Pat. No. 4,956,330 to Elliott et al.; U.S. Pat. No. 5,050,621 to Creighton et al.; U.S. Pat. No. 5,258,340 to Augustine et al.; U.S. Pat. No. 6,503,475 to McCormick; U.S. Pat. No. 6,503,475 to McCormick, U.S. Pat. No. 7,011,096 to Li et al.; U.S. Pat. No. 7,152,609 to Li et al.; U.S. Pat. No. 7,165,553 to Luan et al.; U.S. Pat. No. 7,228,862 to Hajaligol et al.; U.S. Pat. No. 7,509,961 to Saoud et al.; U.S. Pat. No. 7,549,427 to Dellinger et al.; U.S. Pat. No. 7,560,410 to Pillai et al.; and U.S. Pat. No. 7,566,681 to Bock et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; 2005/0274390 to Banerjee et al.; 2007/0215168 to Banerjee et al.; 2007/0251658 to Gedevanishvili et al.; 2010/0065075 to Banerjee et al.; 2010/0125039 to Banerjee et al.; and 2010/0122708 to Sears et al., all of which are incorporated by reference herein in their entirety.

Catalytic fibers can be constructed by, for example, imbedding particles of a catalytic material into the fiber structure or coating the fiber with a catalytic material, such as metal oxide particles. The amount of catalytic material present in the fiber can vary, but is typically about 10 to about 50 percent by weight, based on the total weight of the ion exchange fiber, more often about 20 to about 40 percent by weight. PCT Application No. WO 1993/005868, also incorporated herein by reference, describes the use of catalytic fibers formed by coating a surface-treated hopcalite material, which is a material including both copper oxides and manganese oxides available from the North Carolina Center for Research located in Morrisville, N.C., onto a fibrous support. In particular, the catalyst described in this reference will oxidize gases such as methane and non-methane hydrocarbons and halogenated hydrocarbons at room temperature.

Figure 3:
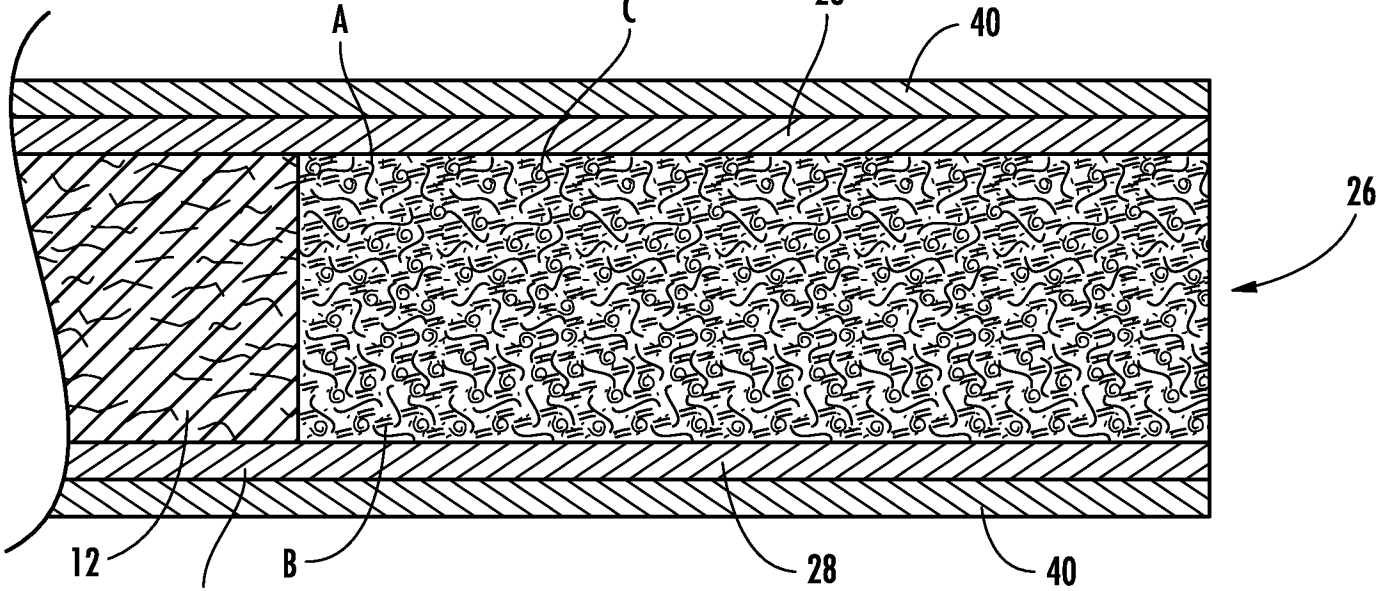
FIG. 3 is a cross-sectional view of a filtered cigarette comprising multiple fibrous filter materials according to another aspect of the invention.

FIG. 3 illustrates a cross-sectional view of an exemplary filter element 26 according to the above embodiment of the invention. The filter rod 26 includes a fibrous tow segment that comprises a mixture of four separate fibrous materials in filamentary tow form. First, the fibrous tow may include either conventional cellulose acetate or polypropylene fibers or treated multifunctional fibers of the type shown in FIG. 2. In addition, the fibrous tow segment also includes a carbon fiber component A, an ionic exchange fiber component B, and a catalytic fiber component C. In an alternative embodiment shown in FIG. 4, the filter element 26 includes two fibrous tow filter segments, 26*a* and 26*b*. The fibrous tow filter segment 26*a* at the tobacco end of the filter element 26 includes the multiple different fiber components as described in relation to FIG. 2. and the fibrous tow filter segment 26*b* at the mouth end of the filter element comprises a conventional fibrous tow filter material such as cellulose acetate tow.

Figure 4:
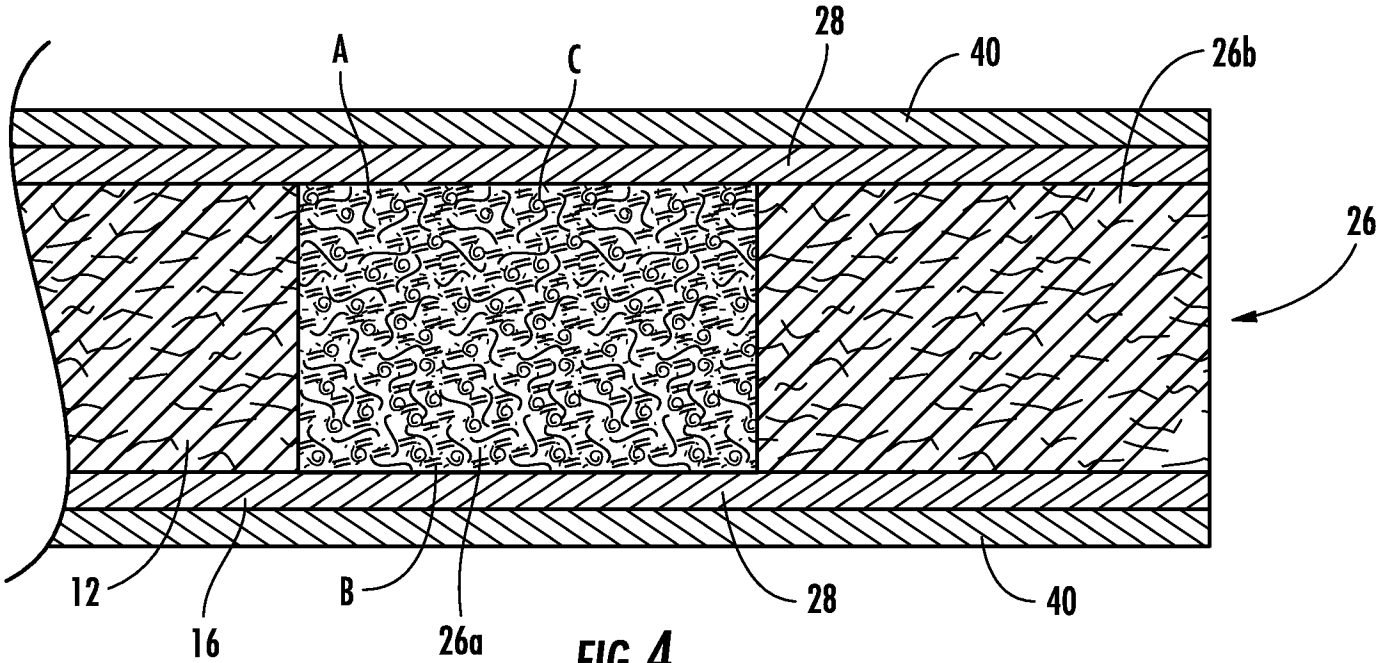
FIG. 4 is cross-sectional view of an alternative embodiment of a filtered cigarette comprising multiple fibrous filter materials according to the invention.

FIGS. 3-4 illustrate filter embodiments having one or two fibrous tow filter segments. However, the invention encompasses embodiments where more than two filter segments are present in the filter. Typically, filter elements according to the invention have 1 to 6 segments, frequently 2 to 4 segments.

Although FIGS. 3-4 illustrate embodiments where four different fiber types are mixed in the same fibrous tow filter segment, the invention encompasses embodiments that include fewer than four different fiber types and embodiments where the different fiber types are separated into different filter segments. For example, the invention includes filter element embodiments where individual fibrous tow filter segments comprise the following combinations: a mixture of the multifunctional fibers illustrated in FIG. 2 with one or more of carbon fibers, ion exchange fibers, and catalytic fibers; a mixture of carbon fibers with one or both of ion exchange fibers and catalytic fibers; and a mixture of ion exchange fibers with catalytic fibers. The different fiber types could be present in the same fibrous tow segment or each individual fiber type could be segregated within its own fibrous tow segment. Alternatively, multiple distinct mixtures of fibers could be used in different fibrous tow segments, such as a filter element containing a first segment comprising a fibrous tow mixture of catalytic fibers and carbon fibers and a second segment comprising a fibrous tow mixture of ion exchange fibers and conventional cellulose acetate fibers or treated cellulose acetate fibers of the type shown in FIG. 2.

The dimensions of a representative cigarette 10 can vary. Preferred cigarettes are rod-shaped, and can have a circumference of about 12 mm to about 30 mm, often about 16 mm to about 25 mm; and can have a total length of about 70 mm to about 120 mm, often about 90 mm to about 110 mm.

The length of the filter element 26 can vary. Typical filter elements can have total lengths of about 20 mm to about 40 mm, often about 20 mm to about 30 mm. For filters comprising multiple segments of different construction, each segment typically has a length of about 5 to about 15 mm.

For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the level of air dilution for an air diluted cigarette is less than about 80 percent, and often less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

Typically, pressure drop values of cigarettes, which correspond to resistance to draw, are measured using a Filtrona Cigarette Test Station (CTS Series) available form Filtrona Instruments and Automation Ltd. Pressure drop can be expressed as mm of water required to draw 17.5 cc/sec of air through or across the filter region from the tobacco rod side to the mouth end of the filter element. An exemplary cigarette exhibits a pressure drop of between about 100 and about 300 mm water pressure drop at 17.5 cc/sec air flow. Preferred cigarettes exhibit pressure drop values of between about 150 mm and about 200 mm water pressure drop at 17.5 cc/sec air flow.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; US Patent Publication Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Most preferably, the entire smokable rod is composed of smokable material (e.g., tobacco cut filler) and a layer of circumscribing outer wrapping material.

The wrapping material used as the tipping material and the plug wrap (i.e., the outer wrapping layers of the filter element 26), or used as the wrapping material 16 for the smokable rod, can be constructed using conventional paper wrapping materials. Typically, the wrapping material comprises a fibrous material and at least one filler material imbedded or dispersed within the fibrous material. The fibrous material can vary, but is typically a cellulosic material. The filler material typically has the form of essentially water insoluble particles, and may incorporate inorganic components. Exemplary filler materials include calcium carbonate, calcium tartrate, magnesium oxide, magnesium hydroxide gels; magnesium carbonate, clays, diatomaceous earth materials, titanium dioxide, gamma alumina materials, and calcium sulfate particles.

Exemplary types of wrapping materials, wrapping material components, and treated wrapping materials are described in U.S. Pat. No. 4,804,002 to Herron; U.S. Pat. No. 4,941,486 to Dube et al.; U.S. Pat. No. 5,105,838 to White et al.; U.S. Pat. No. 5,271,419 to Arzonico et al. U.S. Pat. No. 5,220,930 to Gentry; U.S. Pat. No. 5,490,875 to Wermers et al.; U.S. Pat. No. 6,706,120 to Miyauchi et al.; U.S. Pat. No. 7,195,019 to Hancock et al.; U.S. Pat. No. 7,237,559 to Ashcraft et al.; and U.S. Pat. No. 7,275,548 to Hancock et al.; US Pat. Appl. Pub. Nos. 2003/0114298 to Woodhead et al.; 2003/0131860 to Ashcraft et al. and 2004/0237980 to Holmes; PCT WO 01/08514 to Fournier et al.; and PCT WO 03/043450 to Hajaligol et al.; which are incorporated herein by reference. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. The porosity of the wrapping materials can vary, and frequently is between about 0 CORESTA units and about 100 CORESTA units, often between about 10 CORESTA units and about 90 CORESTA units, and frequently between about 20 CORESTA units and about 80 CORESTA units.

Filter element components or segments for filter elements for multi-segment filtered cigarettes typically are prepared from filter rods using the types of rod-forming units that traditionally have been employed to provide multi-segment cigarette filter components, such as those available as KDF-2 and KDF-3E from Hauni-Werke Korber & Co. KG. Typically, filter material, such as filter tow, is provided using a tow processing unit. An exemplary tow processing unit capable of processing cellulose acetate tow has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al., which are incorporated herein by reference. Other types of technologies for supplying filter materials to a filter rod-forming unit are set forth in U.S. Pat. No. 4,807,809 to Pryor et al. and U.S. Pat. No. 5,025,814 to Raker, which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and US Pat. Appl. Pub. Nos. 2005/0103355 to Holmes, 2005/1094014 to Read, Jr., and 2006/0169295 to Draghetti, each of which is incorporated herein by reference.

Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; US Pat. Appl. Pub. Nos. 2002/0166563 to Jupe et al., 2004/0261807 to Dube et al.; 2005/0066981 to Crooks et al.; 2006/0090769 to Woodson et al.; 2006/0124142 to Zhang; 2006/0144412 to Mishra et al., 2006/0157070 to Belcastro et al.; and 2007/0056600 to Coleman, III et al.; PCT WO 03/009711 to Kim; and PCT WO 03/047836 to Xue et al., all of which are incorporated herein by reference.

Filter elements of the present invention can be incorporated within conventional cigarettes configured for combustion of a smokable material, and also within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No.

5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and US Pat. Appl. Pub. Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and US Pat. Appl. Pub. No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of providing a cellulose acetate fibrous tow containing an imbedded adsorbent material comprising:

treating a particulate adsorbent material with an encapsulant to produce encapsulated adsorbent particles;

mixing a plurality of encapsulated adsorbent particles with a cellulose acetate dope comprising cellulose acetate dissolved in a liquid solvent;

spinning the cellulose acetate dope into filaments having encapsulated adsorbent particles imbedded therein; and removing at least a portion of the encapsulant from the encapsulated adsorbent particles imbedded in the filaments such that at least a portion of the adsorbent particles have a surface area portion exposed on the surface of the filaments.

2. The method of claim 1, further comprising the step of coating the outer surface of the filaments with a coating comprising a plurality of reactive groups adapted for reaction with one or more components of mainstream smoke, wherein the coating step occurs either before or after said removing step.

3. The method of claim 2, wherein said coating step comprises subjecting the filaments to a plasma treatment.

4. The method of claim 1, wherein said removing step comprises treating the filaments with a solvent, exposing the filaments to a light source, or subjecting the filaments to biodegradation conditions.

5. The method of claim 1, wherein the encapsulant is soluble in a solvent selected from the group consisting of water, supercritical carbon dioxide, and liquid nitrogen, and said removing step comprises treating the filaments with the solvent.

6. The method of claim 1, further comprising the step of collecting the filaments in a tow band.

7. The method of claim 1, wherein the encapsulant is selected from the group consisting of surfactants, inorganic salts, polymer salts, polyvinyl alcohols, waxes, photo-reactive materials, biodegradable materials, ethoxylated acetylenic diols, and combinations thereof.

8. The method of claim 1, wherein the encapsulant is water-soluble.

9. The method of claim 1, wherein the adsorbent material is selected from the group consisting of activated carbon, molecular sieves, clay, ion exchange resins, activated alumina, silica gel, meerschaum, and combinations thereof.

10. The method of claim 1, wherein the adsorbent material is activated carbon.

11. The method of claim 1, wherein the solvent is selected from the group consisting of acetone, methanol, methylene chloride, and mixtures thereof.

12. The method of claim 1, wherein the step of mixing a plurality of encapsulated adsorbent particles with a cellulose acetate dope comprises admixing the particles into the cellulose acetate dope or dry-blending the particles into the cellulose acetate prior to forming the dope.

13. The method of claim 1, wherein the amount of adsorbent particles is in the range of about 5 to about 50% by weight, based on the total weight of the cellulose acetate dope.

14. The method of claim 2, wherein the coating comprising a plurality of reactive groups attached to the surface of each individual filament by chemisorption or physisorption.

15. The method of claim 2, wherein the reactive groups are adapted for reaction with one or more components of mainstream smoke selected from the group consisting of hydrogen cyanide, pyridine, quinoline, butadiene, toluidine, naphthylamine, carbon monoxide, nitric oxide, nitrogen dioxide, mercury, cadmium, methanol, isoprene, acetone, acrolein, methyl ethyl ketone, acrylonitrile, benzene, toluene, styrene, phenols, and aldehydes.

16. The method of claim 2, wherein the reactive groups are selected from the group consisting of amino groups, nanoparticles, thiol groups, copper ions, and combinations thereof.

17. The method of claim 6, further comprising withdrawing the filaments from the tow band and forming the filaments into a filter element for a smoking article.

18. The method of claim 17, wherein the filter element further comprises one or more of activated carbon filaments, ion exchange filaments, and catalytic filaments.

19. The method of claim 17, wherein the process of withdrawing the filaments from the tow band and forming the filaments into a filter element comprise one or more of the following steps:

i) mechanically withdrawing the filaments in tow form from a bale;

ii) separating the filaments into a ribbon-like band;

iii) blooming the band to separate the band into individual fibers;

iv) applying a plasticizer to the bloomed fibers; and v) wrapping the fibers in plug wrap.

20. A method of providing a tow containing an imbedded adsorbent material comprising:

receiving encapsulated adsorbent particles comprising a particulate adsorbent material treated with an encapsulant;

forming a cellulose acetate or polyolefin dope by dissolving the cellulose acetate or the polyolefin in a solvent, the encapsulated adsorbent particles being insoluble in the solvent;

forming a mixture of the cellulose acetate or polyolefin dope with a plurality of the encapsulated adsorbent particles, the mixture formed by either dry-blending the encapsulated adsorbent particles with the cellulose acetate or the polyolefin prior to forming the dope or admixing the encapsulated adsorbent particles with the cellulose acetate or polyolefin dope;

spinning the cellulose acetate or polyolefin dope into filaments having the encapsulated adsorbent particles imbedded therein;

removing at least a portion of the encapsulant from the encapsulated adsorbent particles imbedded in the filaments such that at least a portion of the adsorbent particles have a surface area portion exposed on the surface of the filaments; and collecting the filaments in a tow band.

* * * * *